United States Patent [19]

Klauck

[11] 4,372,849

[45] Feb. 8, 1983

[54] HYDRAULIC PUMPING AND SWITCHING APPARATUS

[75] Inventor: Manfred Klauck, Lebach, Fed. Rep. of Germany

[73] Assignee: Flutec Fluidtechnische Gerate GmbH, Fed. Rep. of Germany

[21] Appl. No.: 167,355

[22] Filed: Jul. 10, 1980

[30] Foreign Application Priority Data

Jul. 11, 1979 [DE] Fed. Rep. of Germany ..... 2927971

[51] Int. Cl.[3] ..... B01D 35/02

[52] U.S. Cl. ..... 210/167; 210/416.5; 210/418

[58] Field of Search ..... 210/167, 168, 416.5, 210/418, 420, 424, 426, 433.1

[56] References Cited

U.S. PATENT DOCUMENTS 2,454,124 11/1948 Biasch et al. ..... 210/424 X
2,895,883 7/1959 Hobson ..... 210/168 X
3,428,089 2/1969 Kachergis ..... 210/424 X
3,945,208 3/1976 O'Connor ..... 210/167 X

*Primary Examiner*—John Adee
*Attorney, Agent, or Firm*—Roylance, Abrams, Berdo & Farley

[57] ABSTRACT

A compact hydraulic pumping and switching apparatus capable of pumping a hydraulic liquid in connection with an operating liquid supply tank, a clean liquid tank and a dirty liquid reservoir tank in three different modes. One mode fills the supply tank and filters the liquid. A second merely filters liquid from the supply tank. And the third drains the supply tank without filtering the liquid. The apparatus comprises a carrier coupling together, into a single unit, a motor, a pump, a filter and a switching device. The switching device has two spherical stop cocks therein, each with a passage comprising two perpendicular portions. The switching device is connected to the supply tank at two connections and to the clean liquid tank and to the dirty liquid reservoir tank at one connection respectively.

8 Claims, 6 Drawing Figures

HYDRAULIC PUMPING AND SWITCHING APPARATUS

FIELD OF THE INVENTION

The invention relates to a compact apparatus for pumping hydraulic liquid in connection with a supply tank, an operating liquid stock or clean liquid tank and a dirty liquid reservoir tank. A switching device provides three pumping modes. One mode fills the supply tank and filters the liquid. A second merely filters liquid from the supply tank. And the third drains the supply tank to the dirty liquid tank without filtering the liquid.

BACKGROUND OF THE INVENTION

Prior art pumping and switching devices for liquids are typically very complicated, take up significant space and are very heavy. These devices are used extensively for pumping liquids such as hydraulic oil or similar fluid between a supply tank and a load, such as a hydraulically operated mechanism, for example, a piston and cylinder. Moreover, when a filtering capability of the liquid is added to the pumping and switching devices, a further complication is provided to the overall system, which also increases the space the system occupies.

SUMMARY

Accordingly, it is an object of the present invention to provide a hydraulic pumping and switching apparatus which has a compact construction in a single unit.

Another object of the present invention is to provide such an apparatus which is light in weight and occupies a limited amount of space.

Another object of the present invention is to provide such an apparatus capable of filtering a liquid without unduly complicating the overall system involved.

Another object of the present invention is to provide a simple switching mechanism capable of operating in three different modes as desired.

The foregoing objects are basically attained by providing an apparatus for selectively delivering a hydraulic liquid to a hydraulic supply tank, filtering the hydraulic liquid and draining the liquid from the tank including a pump operated by a motor, a filter, and two connections to the supply tank and two connections to a dirty liquid reservoir tank and a clean liquid tank respectively, wherein the improvement comprises a hydraulic liquid switching device; and a carrier assembly for structurally coupling the motor, the pump, the filter and the hydraulic liquid switching device in a single unit.

The switching device has the capability of selectively delivering hydraulic liquid between a first of the connections with the supply tank and a connection with the clean liquid tank across the filter, delivering hydraulic liquid from the second of the connections with the supply tank across the filter and back to the first of the connections with the supply tank, and delivering hydraulic liquid between the second of the connections with the supply tank and an other connection with the dirty liquid reservoir tank without crossing the filter.

The switching device also includes two substantially spherical stop cocks, each having a passage comprising two perpendicular portions and a control shaft rigidly coupled to the two stop cocks and rotatable to three different positions, one for each switching mode, by means of a lever arm coupled thereto. A first set of three bores extend, respectively, from one of the stop cocks to the pump, to one of the connections with the supply tank and to the connection with the stock or clean liquid tank. A second set of three bores extend, respectively, from the other of the stop cocks to the pump, to the other of the connections with the supply tank and to the connection with the dirty liquid reservoir tank.

Other objects, advantages and salient features of the present invention will become apparent from the following detailed description, which, taken in conjunction with the annexed drawings, discloses a preferred embodiment of the present invention.

DRAWINGS

Referring now to the drawings which form a part of this original disclosure:

Figure 1:
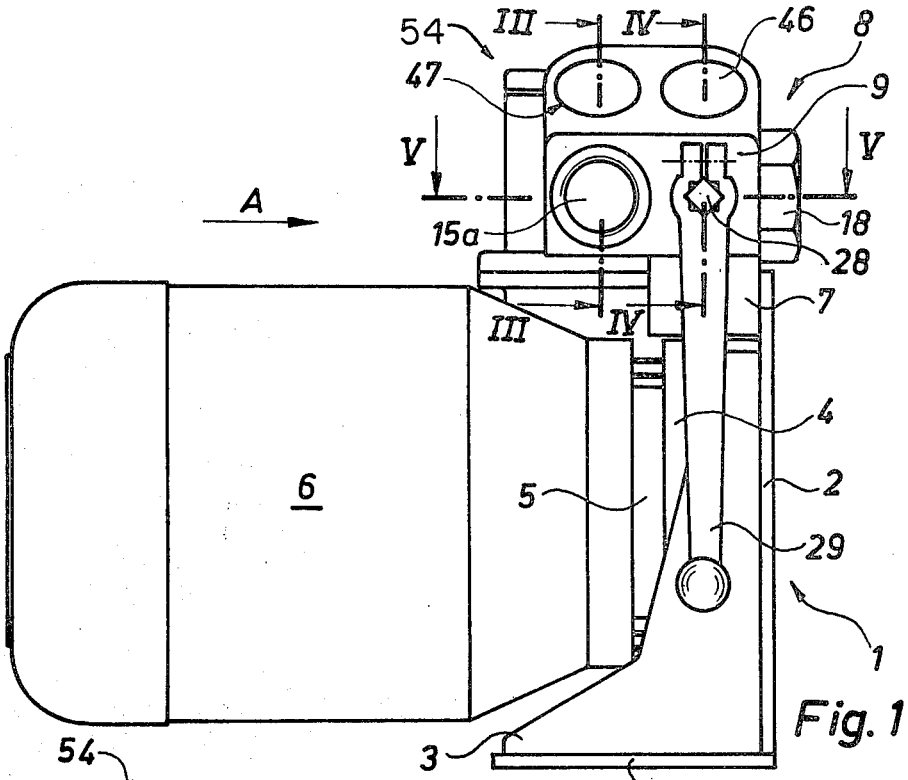
FIG. 1 is a side view of the hydraulic pumping and switching apparatus in accordance with the present invention.
Figure 3:
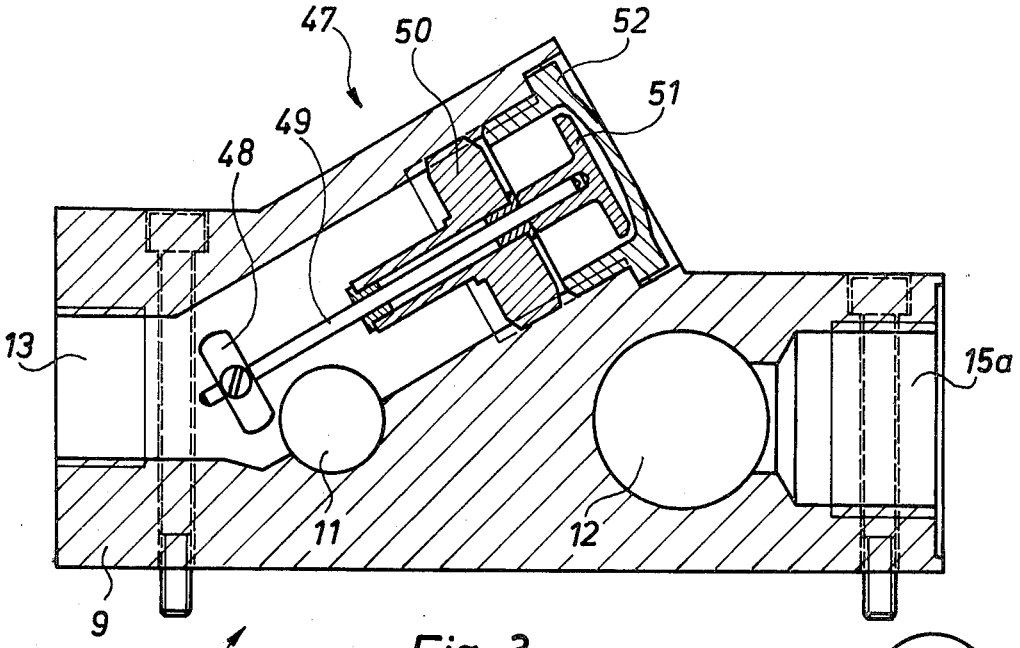
Figure 4:
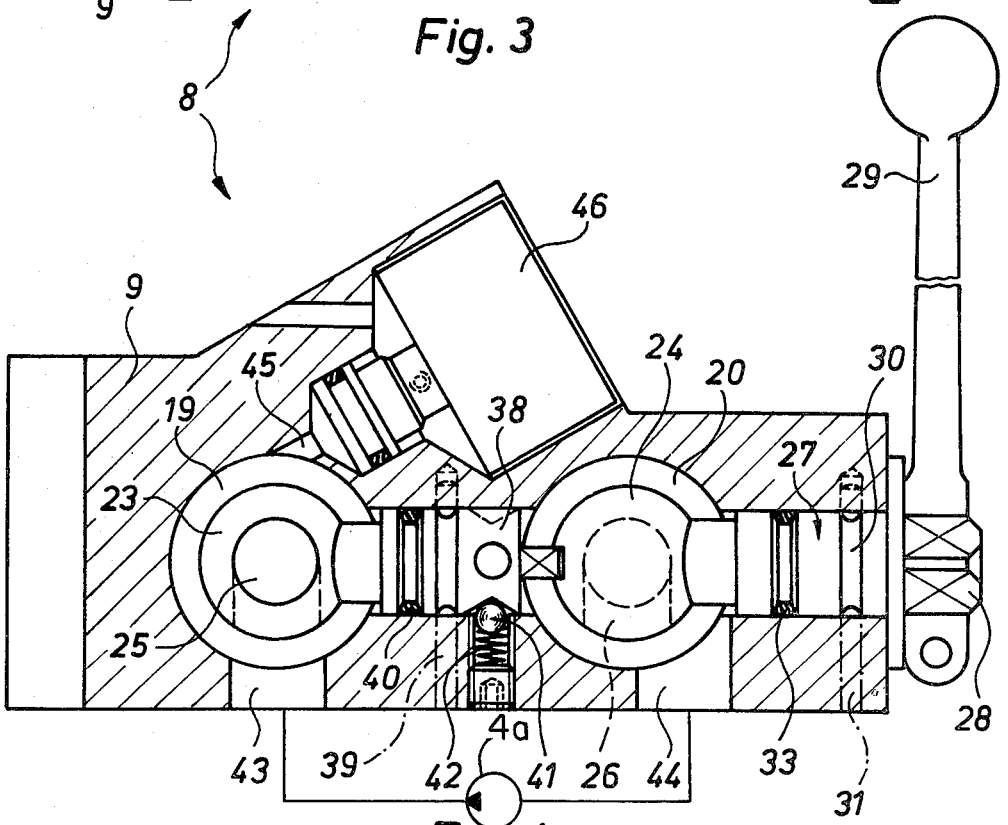
Figure 5:
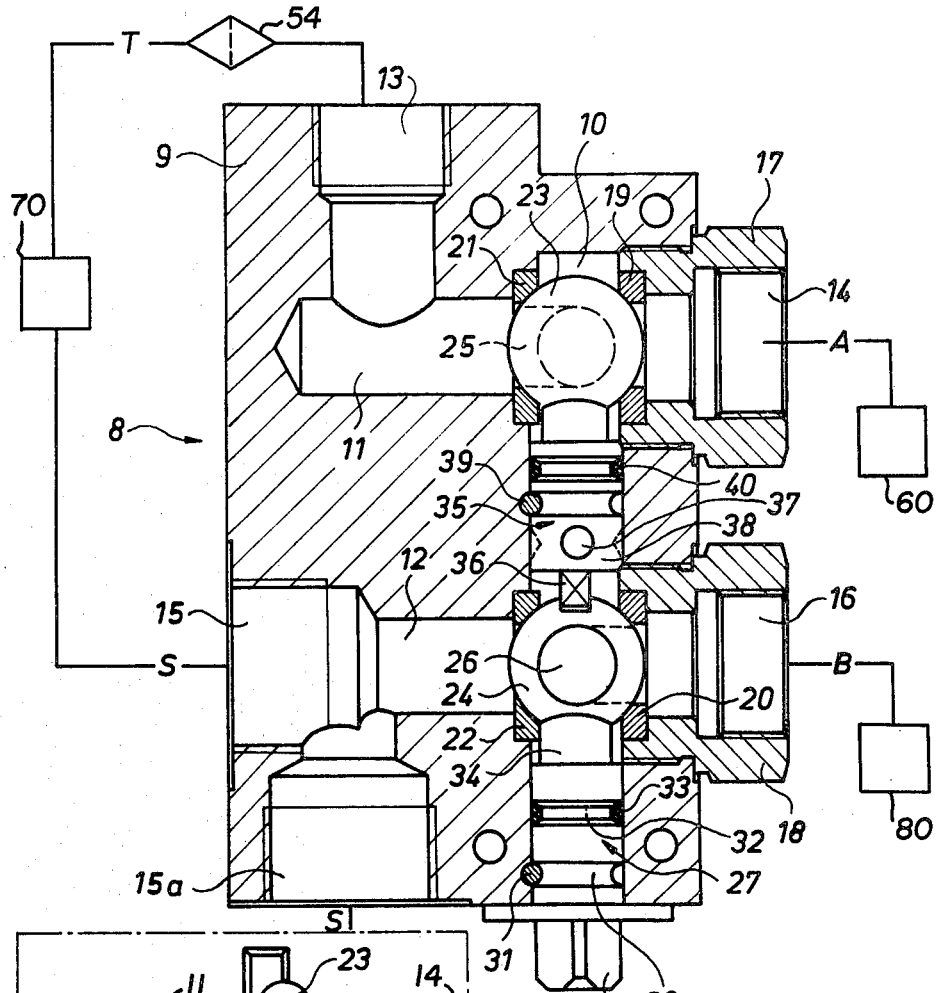
Figure 6:
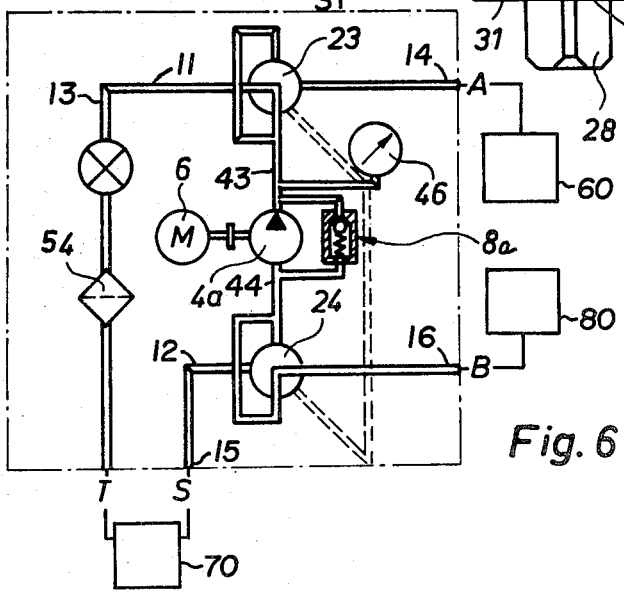

FIGS. 3–5 each show a sectional view, respectively, along lines III—III, IV—IV, and V—V in FIG. 1 on an enlarged scale; and FIG. 6 is a schematic flow diagram of the apparatus in accordance with the present invention.

DETAILED DESCRIPTION OF THE INVENTION

Figure 2:
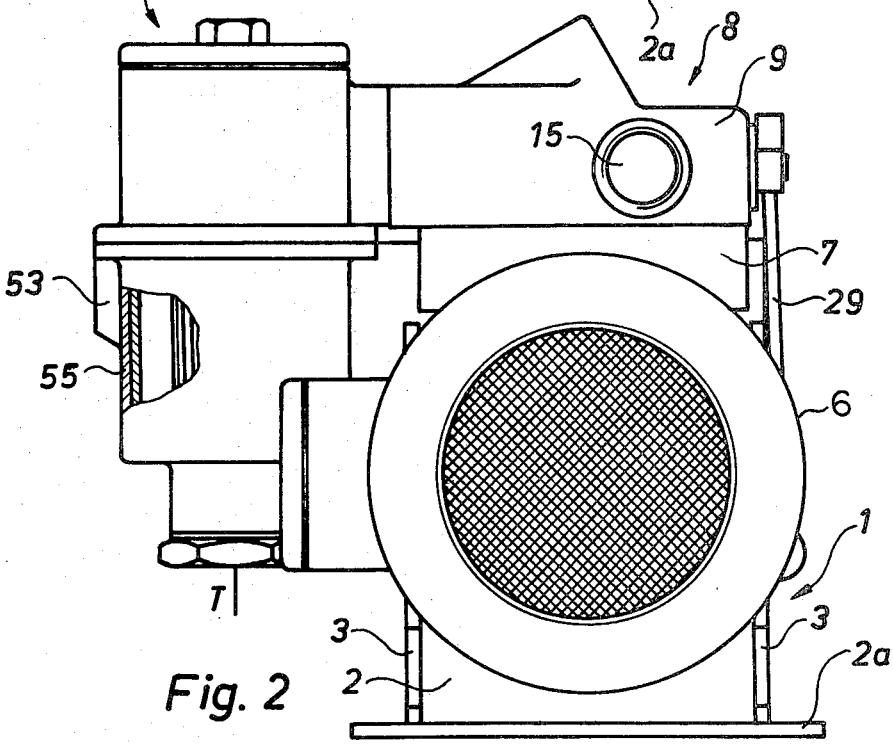
FIG. 2 is a view taken in the direction of the arrow A in FIG. 1.

As seen in FIGS. 1 and 2, a carrier piece 1 has a holding plate 2 rigidly coupled perpendicularly thereto and a horizontally oriented foot plate **2*a* attached at the bottom thereof. Perpendicularly oriented to the holding plate 2 and to the foot plate 2*a*, are two reinforcing plates 3** disposed on the two sides thereof.

Between the two reinforcing plates 3, a pump housing 4 is coupled to the holding plate 2, which is connected by means of an intermediate ring 5 with the housing of a driving motor 6 disposed coaxially thereto. The shaft of the driving motor 6 carries a pump wheel of a roller cell pump and thereby drives the pump. The pump housing 4 has two vertical bores which are spaced apart.

A connecting piece 7 is disposed on the pump housing 4, which has two bores coaxial with the vertical bores disposed in the pump housing 4, between which a connection with a non-return, i.e., one-way, valve **8*a* has been disposed, which opens towards the suction side of the pump 4*a*, as seen in FIG. 6. Above the connection piece 7 is a control device in the form of a hydraulic liquid switching device 8, which has a control housing 9 formed of an integral piece of material, the details of which are shown in FIGS. 3–5**.

The control housing 9 has a longitudinal blind bore 10, into which two transverse bores 11 and 12 lead, the transverse bores being perpendicular to the longitudinal bore 10. The transverse bore 11 is connected with a connection 13 disposed at an angle thereto, which connection 13 is in turn connected with filter 54. Transverse bore 11 is also connected with a first connection 14 for a dirty liquid reservoir tank 60, shown in FIG. 6, for the hydraulic fluid. The transverse bore 12 is connected on one side with an operating liquid supply tank, 70 shown in FIG. 6, by way of either of two connections 15 and **15*a*** which are disposed at right angles to one another. The operating liquid supply tank delivers the hydraulic liquid to a hydraulically operated device, for example, a hydraulic piston and cylinder. The transverse bore 12 on the other side is connected with the clean liquid tank 80, shown in FIG. 6, by way of a second connection 16. The connections 14 and 16 are in connecting pieces 17 and 18 screwed into the control housing 9. Each of the connecting pieces 17 and 18 carries an annular sealing cup 19 and 20 which are disposed in the mouth of the transverse bores 11 and 12 and extend into the longitudinal bore 10. Each of these cups 19 and 20 has an opposed corresponding sealing cup 21 and 22, sealing cups 19 and 20 being embedded into the connecting pieces 17 and 18 and the other sealing cups 21 and 22 being embedded into the control housing 9. Between the sealing cups 19 and 21, there is a substantially spherical stop cock 23 and between sealing cups 20 and 22 there is a substantially spherical stop cock 24.

The stop cocks 23 and 24 are rotatably mounted in the opposed sets of sealing cups 19 and 21, and 20 and 22, each of the stop cocks having bored passages 25 and 26 comprising two portions arranged at right angles.

The stop cock 24 is rotatable by means of a control shaft 27 oriented perpendicularly to the plane containing passage 26. On the outside of the control shaft 27, there is a polygonal extension 28 for non-rotatably receiving a suitably shaped control lever 29 and a fitting collar which fits on the outside of the control housing 9 so that the control lever 29 can rotate the control shaft 27. Within the longitudinal bore 10, the control shaft 27 has an annular groove 30 with which a transverse peg or retaining pin 31 serves to secure the axial position of the control shaft 27. An annular groove 32 adjacent groove 30 serves to receive a gasket or O-ring 33. There then follows on the control shaft a part 34 disposed from the wall of the longitudinal bore 10 and rigidly connected with the second stop cock 24.

A short control shaft 35 rigidly connected with the other stop cock 23 engages in a positive rotational manner with the stop cock 24 by means of a connecting peg 36. The connecting peg 36 is followed by a notch-shaped rotational positioning and safety mechanism with cone-shaped bores 37 disposed at equal circumferential distances and with radial axes in a collar 38 extending to the wall of the longitudinal bore 10. There then follow two spaced annular grooves on shaft 35 for the engagement of a transverse peg 39 which corresponds to transverse peg 31 and which has the same purpose, as well as for the reception of a gasket or O-ring 40. The stop cock 23 is connected with the control shaft 35 by way of a connecting piece disposed from the wall of the longitudinal bore 10.

The bores 37 in the collar 38 engage a locking ball 41, as seen in FIG. 4, which is subjected to the action of a locking spring 42, which is supported on the one hand against the locking ball 41 and on the other hand by a screw threaded into the control housing 9.

As seen in FIG. 4, connecting bore 43 leading to the longitudinal bore 10 is provided in the area of stop cock 23 perpendicularly to the transverse bore 11 and another connecting bore 44 likewise leading into the longitudinal bore 10 and likewise perpendicular to the transverse bore 12 is provided in the area of stop cock 24. The connecting bores 43 and 44 are connected with the vertical bores, not shown, in the connecting piece 7 which is attached by means of hollow screws, not shown, and which have sealed channels of passage on the pump housing 4, as seen in FIG. 1. Thus, connecting bores 43 and 44 communicate with the pressure and suction sides of the pump, thereby connecting the stop cocks with the pump so that hydraulic liquid can be pumped from one stop clock to the other via bores 43 and 44 and the pump. In this regard, it is noted that in FIG. 5 each stop cock also has bores extending respectively to the operating liquid supply tank 70 and either the dirty liquid reservoir tank 60 or the clean liquid tank 80. Thus, each stop cock has set of three bores extending therefrom, one to the pump, one to the operating liquid supply tank and one to either the dirty liquid reservoir tank 60 or the clean liquid tank 80.

The connecting bore 43 is connected with the outside surface of the stop cock 23 except for the surfaces limited and covered up by the sealing cups 19 and 21. The same is true for the connecting bore 44 in regard to stop cock 24, the outside surface of which is connected with the connecting bore 44 with the exception of the surfaces limited and covered up by the sealing cups 20 and 22.

In the area of the stop cock 23, a manometer 46 is connected with the longitudinal bore 10 by means of a connecting bore 45, as seen in FIG. 4. A flow indicating device 47 is connected to the connection 13 as seen in FIG. 3. This device has a propeller wheel 48 reaching into the connection between the connection 13 and the transverse bore 11, which is attached in a locally fixed manner on a shaft 49. This shaft 49 is rotatably mounted in a bearing piece 50 screwed into the control housing 9. On the end of the shaft 49 facing away from the propeller wheel 48, a signaling wheel 51 is seated, which is visible from the outside by way of a transparent connecting screw 52, which is U-shaped in cross-section, so that it may be determined whether any hydraulic liquid, or pressure agent, flows between the connection 13 and the transverse bore 11.

The filter 54 with its housing 55 is attached on an arm of the carrier piece 53, in which housing a pot for collecting dirt is housed. The filter housing is connected on its top side with the connection 13 of the control device 8 and on its underside it has a connection designated by T with the operating liquid supply tank 70.

As seen in FIG. 6, a circuit diagram showing the flow of liquid through the apparatus is presented. The two connections on the operating liquid supply tank are designated by T and S, and the two connections to the dirty liquid reservoir tank for old hydraulic liquid and to the stock or clean liquid tank 80 for new hydraulic liquid are designated by A and B respectively, as seen in FIGS. 2, 5 and 6.

In this position as shown in FIG. 6 of the stop cocks 23 and 24, there is a connection between the connections T and B which includes the filter 54. The operating liquid supply tank 70 may be filled with fresh hydraulic liquid and this liquid may be delivered to the supply tank 70 across the filter 14. This occurs by flow being conducted from the stock or clean liquid tank 80 via connection B, connection 16 and connecting piece 18, passage 26 in stop cock 24, connecting bore 44 (FIG. 4), pump 4, connecting bore 43, passage 25 in stop cock 23, transverse bore 11, connection 13, filter 54 and connection T and into the operating liquid supply tank 70.

Whenever the two stop cocks 23 and 24 as seen in FIG. 6 are rotated clockwise through 90° by manipulation of lever 29, then connections T and S are directly interconnected without an other connection. The filter 54 connected with the flow meter in this case is in shunt connection with the operating liquid supply tank 70. Thus, hydraulic liquid in this second mode flows from the supply tank 70 connection S, along connection 15 or 15*a* and transverse bore 12, through passage 26 in stop cock 24, through connecting bore 44, across the pump 4, through connecting bore 43, through passageway 25 in stop cock 23, through transverse bore 11, through connection 13, across filter 54 and into connection T and into the supply tank 70.

Whenever the stop cocks 23 and 24 are again rotated 90° in the clockwise direction shown in FIG. 6, then the connections A and S are connected with one another, as a result of which the hyraulic liquid may be delivered into the dirty liquid reservoir tank 60 from the supply tank 70 without crossing the filter. This mode thus has flow from the connection S through connection 15 or 15*a* and transverse bore 12, passage 26 in stop cock 24, connecting bore 44, pump 4, connecting bore 43, passage 25 in stop cock 23, connection 14 and connecting piece 17 and into connection A and into the dirty liquid reservoir tank 60.

Thus, the switching device is capable of selectively delivering new hydraulic liquid to the operating liquid supply tank 70 via filter 54, filtering hydraulic liquid in the operating liquid supply tank 70 via filter 54 and draining the liquid from the supply tank 70 to the dirty liquid reservoir tank 60 while avoiding the filter as desired by rotating lever 29 to three locations.

While one advantageous embodiment has been chosen to illustrate the invention, it will be understood by those skilled in the art that various changes and modifications can be made therein without departing from the scope of the invention as defined in the appended claims.

What is claimed is:

1. A hydraulic liquid pumping and switching apparatus for use with an operating liquid supply tank having two connections therewith and a clean liquid tank and a dirty liquid reservoir tank each having a connection therewith, the combination comprising:

a carrier piece; and a motor, a pump, a filter and a switching device for the hydraulic liquid coupled to said carrier piece, said switching device having means for selectively delivering hydraulic liquid to a first of the connections with the supply tank from the connection with the clean liquid tank across said filter, delivering hydraulic liquid from the second of the connections with the supply tank across said filter and back to the first of the connections with the supply tank, and delivering hydraulic liquid from the second of the connections with the supply tank to the connection with the dirty liquid reservoir tank without crossing the filter, said means for selectively delivering comprising a control housing, a longitudinal blind bore extending in said control housing, a pair of valves located in said blind bore, means, coupled to said valves, for moving said valves to a plurality of positions, a first set of transverse bores located in said control housing and providing liquid flow, respectively, between one of said valves and said pump, one of the connections with said supply tank and one of the connections with said dirty liquid reservoir tank, and a second set of transverse bores located in said control housing and providing liquid flow, respectively, between the other of said valves and said pump, the other of the connections with said supply tank and the connection with said clean liquid tank.

2. The improvement according to claim 1, wherein said carrier means includes a carrier plate, and further including a hydraulic liquid connecting piece having a one-way valve therein, said connecting piece being located between said switching device and said carrier plate.

3. The improvement according to claim 1 wherein said pair of valves comprises a pair of spaced stop cocks interconnected by a control shaft, each stop cock having an angulated passage therein.

4. The improvement according to claim 3, wherein said stop cock are substantially spherical, each stop cock being received in two spaced, opposed annular sealing cups, the space between two of said sealing cups being connected to the suction side of the pump and the space between the other two of said sealing cups being connected to the pressure side of the pump, each of said sealing cups having a bore therein, two of said bores being connected to the two connections to the supply tank and the other two of said bores being connected to the connections to the clean liquid tank and the dirty liquid reservoir tank respectively.

5. The improvement according to claim 3, wherein said control shaft comprises two parts disposed coaxially and rigidly connected, each part having two annular grooves for the reception of a sealing ring and an axial movement restraining pin, said control shaft having a driving member coupled thereto for rotating said control shaft.

6. The improvement according to claim 5, and further comprising means, located in said switching device, for maintaining said control shaft in a selected rotational position.

7. The improvement according to claim 1, and further comprising a flow meter interposed between said filter and said switching device.

8. An apparatus according to claim 1, wherein said pair of valves include two substantially spherical stop cocks, each having a passage comprising two perpendicular portions.

* * * * *